US009899161B2

(12) United States Patent
Bianco et al.

(10) Patent No.: US 9,899,161 B2
(45) Date of Patent: Feb. 20, 2018

(54) METHOD AND CONTROL SYSTEM FOR CONTROLLING A SWITCHING DEVICE

(71) Applicant: ABB Technology AG, Zurich (CH)

(72) Inventors: Andrea Bianco, Sesto san Giovanni (IT); Andrea Ricci, Dalmine (IT); Fabio Mannino, Curno (IT); Gabriele Valentino De Natale, Milan (IT)

(73) Assignee: ABB SCHWEIZ AG, Baden (CH)

( * ) Notice: Subject to any disclaimer, the term of this patent is extended or adjusted under 35 U.S.C. 154(b) by 275 days.

(21) Appl. No.: 14/983,627

(22) Filed: Dec. 30, 2015

(65) Prior Publication Data

US 2016/0203924 A1 Jul. 14, 2016

(30) Foreign Application Priority Data

Jan. 8, 2015 (EP) ..... 15150502

(51) Int. Cl.
*H01H 9/56* (2006.01)
*H01H 7/16* (2006.01)

(52) U.S. Cl.
CPC ..... *H01H 9/56* (2013.01); *H01H 7/16* (2013.01)

(58) Field of Classification Search
CPC ..... H01H 7/16; H01H 9/56
USPC ..... 307/127, 139, 141
See application file for complete search history.

(56) References Cited

U.S. PATENT DOCUMENTS 5,563,459 A * 10/1996 Kurosawa ..... H01H 9/56 307/141.4
5,821,642 A 10/1998 Nishhira et al.

FOREIGN PATENT DOCUMENTS

EP 2068335 A1 6/2009
EP 2523203 A1 11/2012

OTHER PUBLICATIONS

European Search Report in EP 15150502.1 dated Jul. 6, 2015.

* cited by examiner

*Primary Examiner* — An Luu
(74) *Attorney, Agent, or Firm* — Manelli Selter PLLC; Edward J. Stemberger

(57) ABSTRACT

A method controls a switching device having at least one phase comprising at least one couple of contacts which can be actuated for switching between a closed condition and an open condition. The method provides control means for controlling the actuation of the at least one couple of contacts, such control means being adapted to operate using time cycles; set the time cycles with a predetermined time duration; detects a difference of a value of a parameter associated to the phase with respect a preset value.

16 Claims, 9 Drawing Sheets

METHOD AND CONTROL SYSTEM FOR CONTROLLING A SWITCHING DEVICE

BACKGROUND

The present invention relates to a method for controlling a switching device, in particular for synchronizing actuations of the switching device to a reference electrical signal; the present invention also relates to a control system adapted to carry out such method.

As known, a switching device is a device conceived for connecting/disconnecting two parts of an electrical circuit into which it is installed.

In particular, the switching device comprises one or more electrical phases, each one having at least one couple of contacts which can be switched between a closed condition, where the contacts are coupled to each other, and an open condition, where the contacts are separated from each other.

A control system can be provided for controlling the operations of the switching device, in such a way to synchronize the switching of the contacts to a reference waveform of an electrical signal associated to the electrical circuit into which the switching device itself is installed.

As known, the control system comprises control means which are adapted to operate by using a sequence of time cycles. The time cycles are set with a predetermined time duration.

The control means are adapted to control the actuation of the couple of contacts by using the time cycles with the predetermined time duration. The aim of this control is switching the contacts at a corresponding predetermined electrical angle of the reference waveform.

This predetermined electrical angle can be suitably chosen to avoid, or at least reduce, the generation of electrical arcs, inrush currents and transient voltages during the operation of the switching device.

However, the control means are adapted to execute the above mentioned control while assuming nominal values of relevant electrical and/or mechanical parameters which are associated to the phase and which could condition the desired synchronization of the contact switchings with the reference waveform.

If the real value of such electrical and/or mechanical parameters does not correspond to the presumed nominal value, the control means would fail to keep the desired synchronization as better illustrated with reference to an exemplary known switching device.

An exemplary known switching device comprises, for each electrical phase, two couples of contacts which are operatively associated to at least one semiconductor device.

The two couples of contacts must be switched in sequence at predetermined electrical angles of the reference waveform, in such a way to correctly use the semiconductor device for the switching tasks.

The two couples of contacts are realized by a common movable contact and two corresponding fixed contacts spatially separated from each other.

The movable contact can be actuated between a full-open position, where it is separated from both the first and second fixed contacts, and a closed position where it is coupled to the first fixed contact. The second fixed contact is disposed between the first fixed contact and the movable contact in the full-open position, so as to be connected with the movable contact during a portion of its travel path between the first and second fixed contacts.

An example of such switching device is disclosed in patent application EP2523203, filed in the name of the same applicant of the subject application.

The control means are set to control the actuation of the movable contact using the time cycles with the predetermined time duration, in such a way that:

- the coupling of the movable contact with the second fixed contact starts at a first predetermined point and the coupling of the movable to the first fixed contact occurs at a second, subsequent, predetermined point of the reference waveform;
- the separation of the movable contact from the first fixed occurs at a third predetermined point and the separation of the movable contact from the second fixed contact occurs at a fourth, subsequent, predetermined of the reference waveform.

However, the control means are set to execute the above control while assuming a frequency value of the reference waveform equal to the frequency nominal value of the electric circuit.

In particular, the control means are adapted to apply a delay time between a detection of a predetermined reference point of the waveform and a predetermined starting point of the actuation of the movable contact.

This delay time is set according to the nominal frequency value and, hence, if the real frequency value does not correspond to such nominal value, the starting of the actuation of the movable contact will occur too early or too late with respect to the predetermined starting point.

More periods of the reference waveform the time delay comprises, and more the starting of the actuation will be far from the predetermined starting point.

In addition to such undesired effect, the control means are set to control the actuation of the movable contact while assuming a first preset time interval between the first and second predetermined points, and a second preset time interval between the third and fourth predetermined points of the reference waveform.

These first and second preset time intervals are based on the nominal frequency value.

Hence, a value difference between the real and nominal frequencies means a stretching or a reduction of the real time interval between the first and second predetermined points with respect to the first preset time interval, and a stretching or a reduction of the real time interval between the third and fourth predetermined points with respect to the second preset time interval.

This results in a controlled coupling between the movable contact and first fixed contact occurring too early or too late with respect to the second predetermined point, and in a controlled separation of the movable contact from the second fixed contact occurring too early or too late with respect to the fourth predetermined point of the reference waveform.

Furthermore, the control means are set to execute the control of the movable contact while assuming a distance between the first and second fixed contacts having a value corresponding to a nominal value devised in the design of the switching device.

However, the real value of such distance can vary in each single realized switching device with respect to the nominal designed value, due for example to mechanical tolerances. Since the control means work presuming the nominal distance value, a value difference between the real and nominal distances results in:

a coupling of the movable contact with the first fixed contact occurring too early or too late with respect to the second predetermined point of the reference waveform; and a separation of the movable contact from the second fixed contact occurring too early or too late with respect to the fourth predetermined point of the reference waveform.

Hence, all the above exemplary undesired effects combine each other resulting in a missed synchronization between the controlled actuation of the movable contact and the reference waveform.

SUMMARY

In light of above, at the current state of the art, although known solutions perform in a rather satisfying way, there is still reason and desire for further improvements.

Such desire is fulfilled by a method and apparatus as presented in the claims.

Another aspect of the present invention is to provide a switching device comprising a control system as defined by the annexed claims and disclosed in the following description.

Another aspect of the preset invention is to provide a switchgear comprising a control system and/or a switching device according the annexed claims and disclosed in the following description.

BRIEF DESCRIPTION OF THE DRAWINGS

Further characteristics and advantages will become more apparent from the description of some preferred but not exclusive embodiments of the control system, control method and related switching device according to the invention, illustrated only by way of non-limiting examples with the aid of the accompanying drawings, wherein.

DETAILED DESCRIPTION OF EXAMPLE EMBODIMENTS

Figure 1:
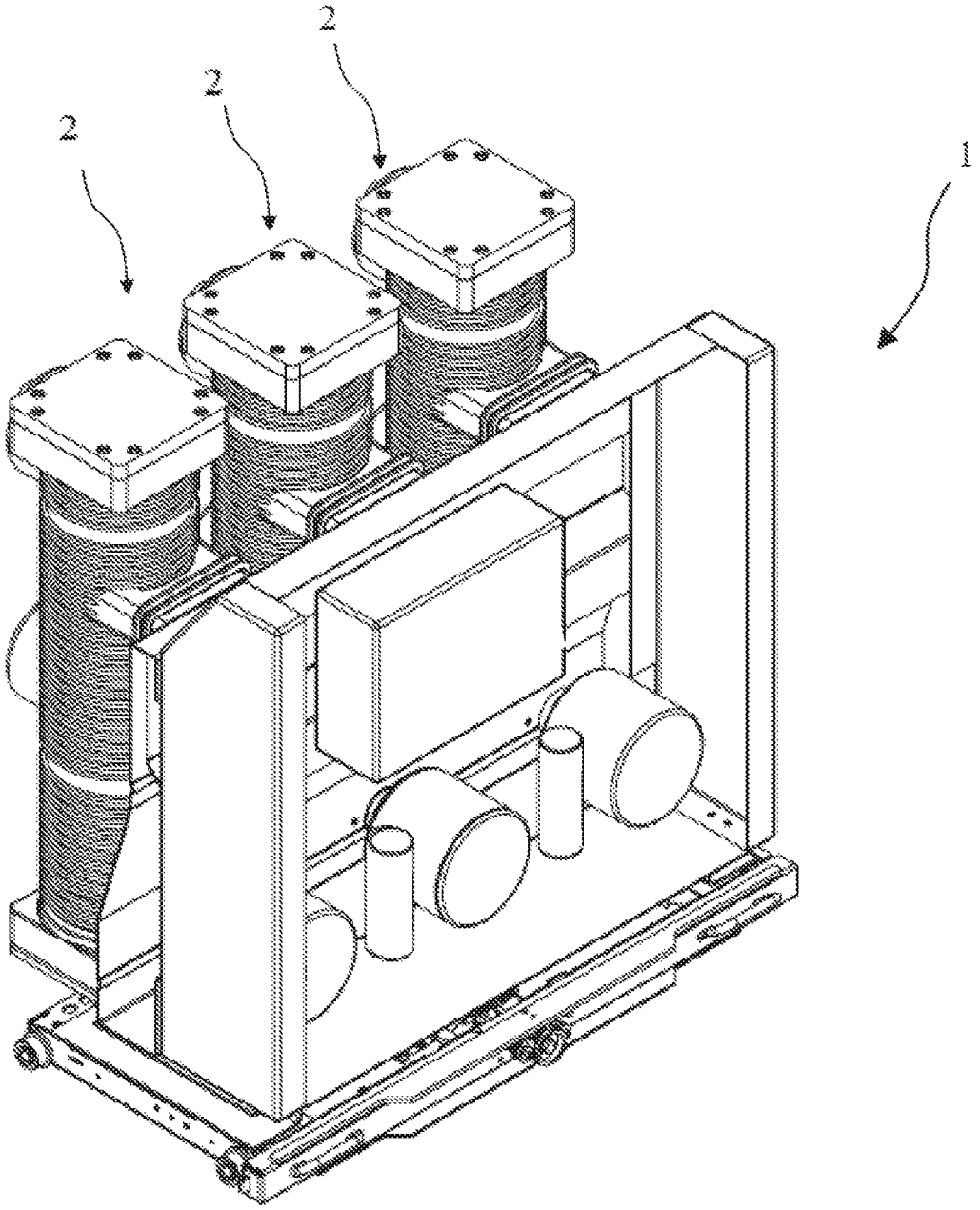
FIG. 1 is a perspective view of a switching device according to the present description.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

Further, when the term "adapted" or "arranged" or "configured" is used herein while referring to any component as a whole, or to any part of a component, or to a whole combinations of components, or even to any part of a combination of components, it has to be understood that it means and encompasses correspondingly either the structure, and/or configuration and/or form and/or positioning of the related component or part thereof, or combinations of components or part thereof, such term refers to.

Figure 8:
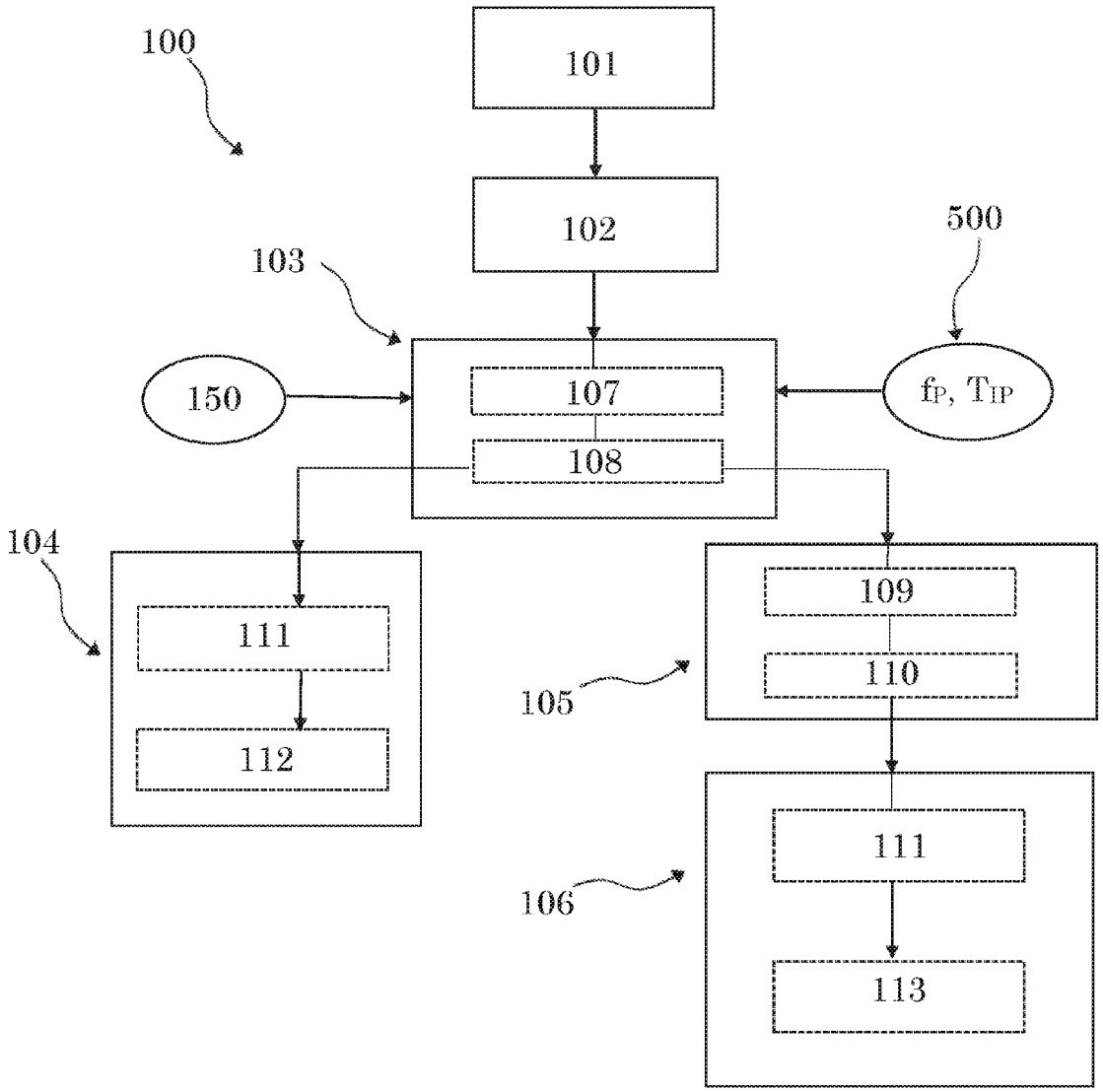
FIG. 8 shows a block diagram which schematically illustrates a method according to the present invention.
Figure 9:
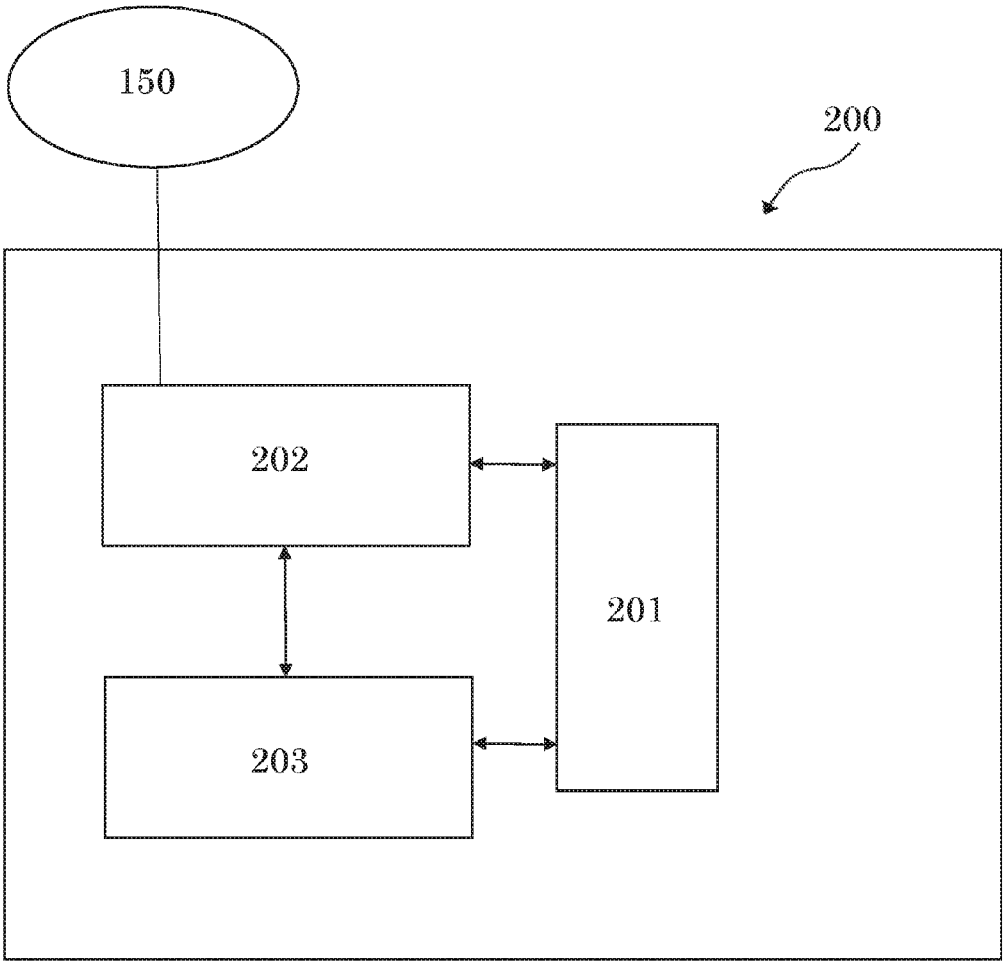
FIG. 9 shows a block diagram which schematically illustrates a control system according to the present invention.

With reference to FIGS. 8 and 9, the present disclosure is related to a method for controlling a switching device 1 and to a control system for carrying out such method; the control method and system are hereinafter globally indicated with numeral references 100 and 200, respectively.

With reference to FIGS. 1-7, the method 100 is adapted to control a switching device 1 for connecting/disconnecting to/from each other two parts 5, 6 of an electric circuit into which the switching device 1 itself can be installed.

The switching device 1 has at least one phase 2 which comprises at least one couple of contacts 3, 4. This at least one couple of contacts 3, 4 can be actuated for switching between a closed condition, where its contacts 10-12, 10-11 are coupled to each other, and an open condition, where its contacts 10-12, 10-11 are separated from each other.

Figure 2:
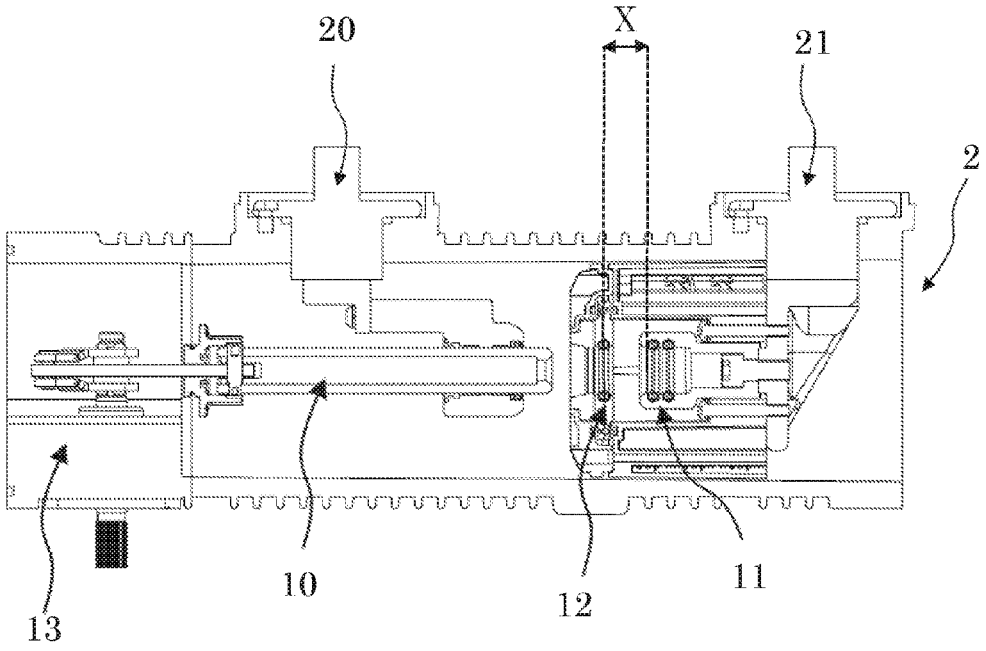
FIGS. 2, 4 and 6 are section views of one electrical phase of the switching device illustrated in FIG. 1, with a movable contact illustrated in different positions.
Figure 3:
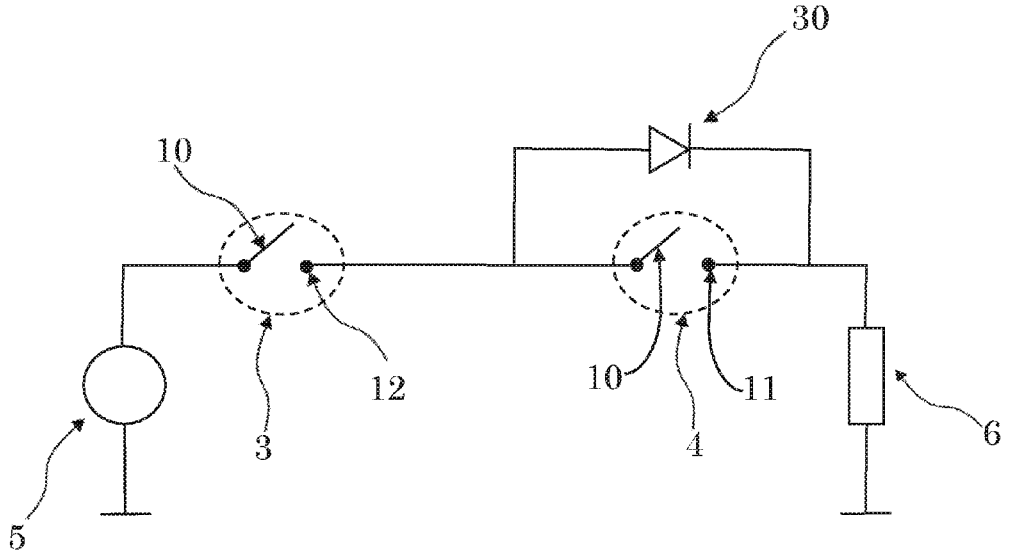
FIGS. 3, 5 and 7 show an electrical scheme of the phase illustrated in FIGS. 2, 4 and 6, respectively.
Figure 4:
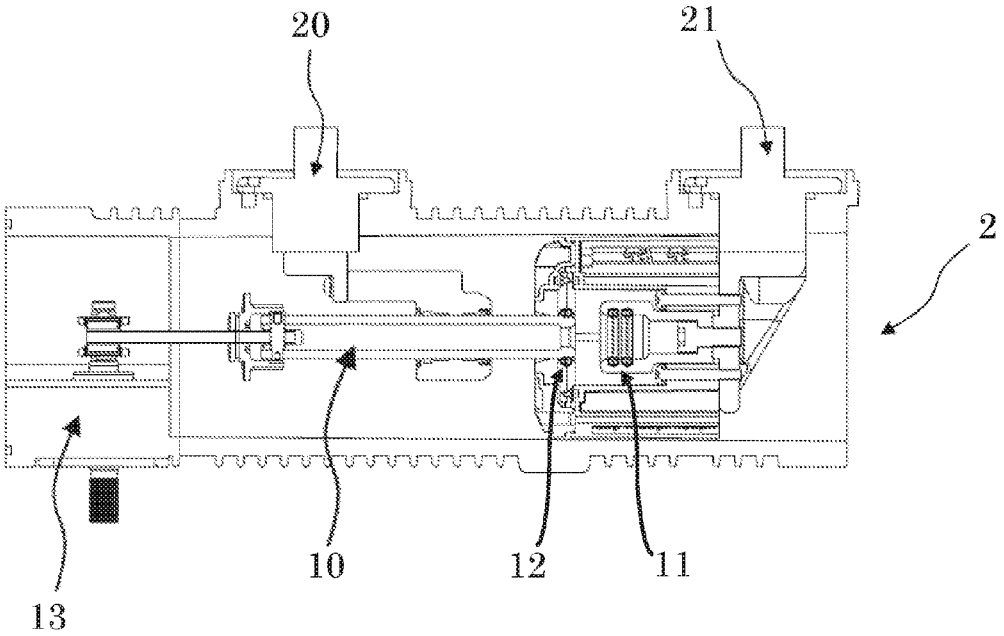
Figure 5:
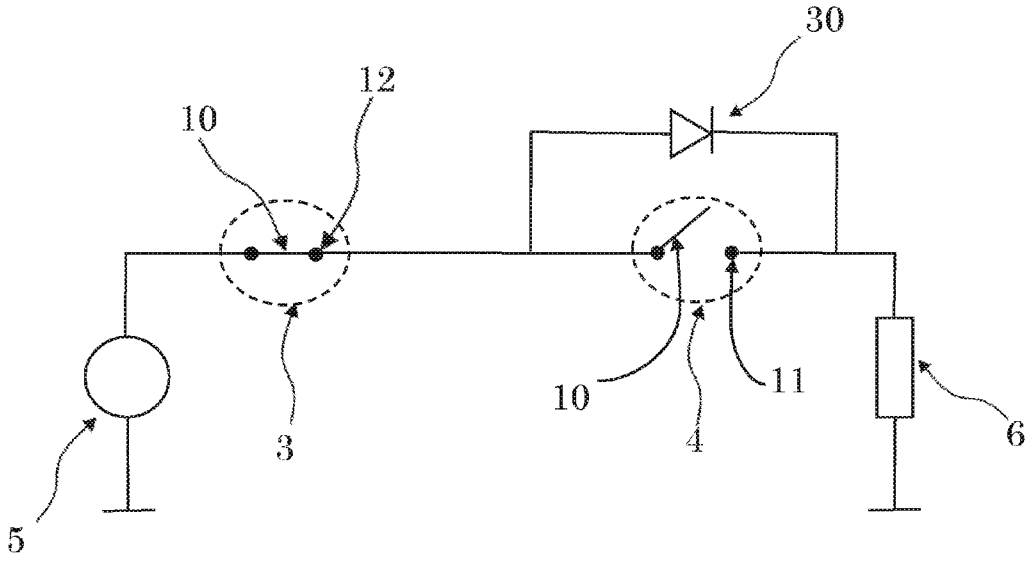

For example, FIGS. 2-4 show one phase 2 of the exemplary switching device 1.

This phase 2 comprises terminals 20, 21 for connecting the phase 2 to a power supply 5 and to an associated load 6 of the electrical circuit.

Further, the phase 2 comprises:

at least one semiconductor device 30 adapted to block a current flowing there-through in a first direction, and to allow a current flowing there-through in a second direction opposed to the first direction;

a first couple of contacts 3 which is adapted to cause, through its switching from the open condition to the closed condition, a connection in series of the at least one semiconductor device 30 between the electrical supply and load 5, 6; and a second couple of contacts 4 which is adapted to short-circuit, through its switching from the open condition to the closed condition, the least one semiconductor device 30.

In the exemplary embodiment illustrated in FIGS. 2-4, the two couples of contacts 3, 4 are realized by a common movable contact 10 and two corresponding fixed contacts 11, 12 which are spatially separated from each other by a distance X.

Figure 6:
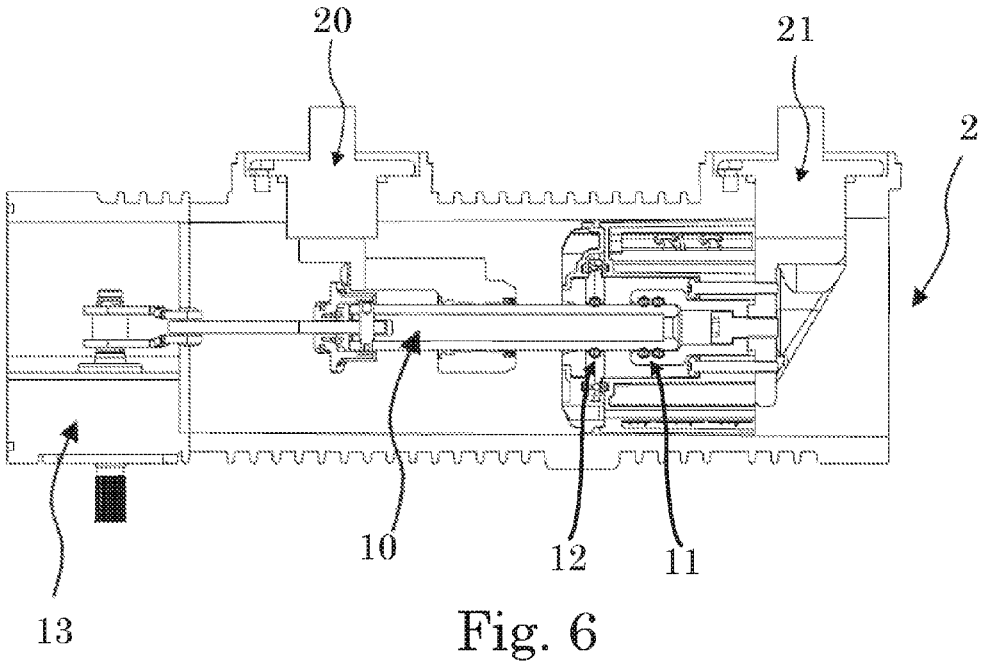
Figure 7:
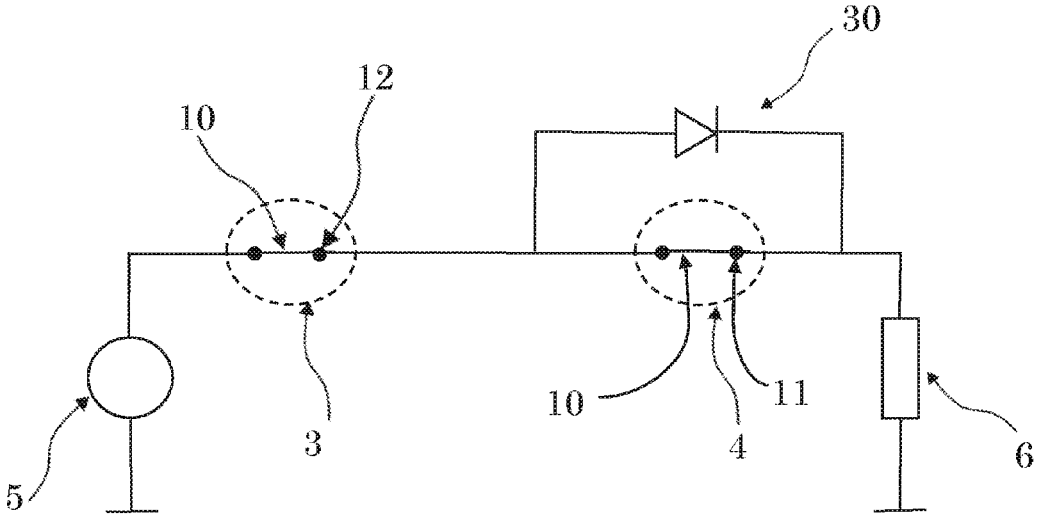

The movable contact 10 can be actuated, for example through a rotating motor 13, between a full-open position (illustrated in FIG. 2), where it is separated from both the fixed contacts 11 and 12, and a closed position where it is coupled to the fixed contact 11 (as illustrated in FIG. 6).

The second fixed contact 12 is disposed between the fixed contact 11 and the movable contact 10 in the full-open position, so as to be connected with the movable contact 10 during a travel path thereof between the fixed contacts 11 and 12.

In practice, the actuation of the movable contact 10 between its full-open and closed positions corresponds to an actuation of the couples of contacts 3, 4, resulting in sequential switchings of these couples 3, 4.

For sake of simplicity, reference it will be made in the following description only to the controlled actuation of the couples of contacts 3, 4 in one phase 2, since the disclosed control principles can be applied to the couples of contacts 3, 4 in the other phases 2.

With reference to FIG. 8, the method 100 according to the present invention comprises the step 101 of providing control means 201 for controlling the actuation of the couples of contacts 3, 4 in the phases 2.

As illustrated in FIG. 9, the control system 200 comprises such control means 201 which are adapted to operate using time cycles 300; in practice, the control means 201 are adapted to execute an operation at each time cycle 300.

The time cycles 300 are initially set with a predetermined time duration $T_P$, according to method step 102.

The method 100 further comprises the step 103 of detecting a difference of a value of at least one parameter 150 associated to the phase 2 with respect to a preset value 500.

In order to implement this step 103, the control system 200 comprises means 202 for detecting the difference between the value of the parameter 150 and the preset value 500.

The method 100 comprises a step 104, that is:

if the value of the parameter 150 corresponds to the preset value 500, controlling the actuation of the at least one couple of contacts 3, 4 of the phase 2 through the control means 201 using the time cycles 300 with the predetermined time duration $T_P$.

This controlling is such that the switching between the open and closed positions of the at least one couple of contacts 3, 4 is controlled to occur at a predetermined electrical angle 351-354 of a waveform 350 of an electrical signal associated to the phase 2.

The control means 201 are adapted to execute such method step 104.

If a difference between the value of the parameter 150 and the preset value 500 is detected by means 202, the control means 201 are advantageously adapted to:

modify the predetermined time duration $T_P$ of the time cycles 300 according to the detected difference (method step 105); and control the actuation of the at least one couple of contacts 3, 4 through the control means 201 using the time cycles 300 with the modified time duration $T_M$ (method step 106).

The modification of the predetermined time duration $T_P$ is such that the switching of the at least one couple of contacts 3,4 is controlled to occur at the same predetermined electrical angle 351-354 of the waveform 350 at which such switching is controlled to occur by method step 104.

In practice, the control means 201 are set to control a predetermined synchronization between the switching of the at least one couple of contacts 3, 4 and the waveform 350, by using time cycles 300 with the initially set time duration $T_P$ and under the condition that the value of the parameter 150 corresponds to the preset value 500.

A difference of the parameter 150 with respect to the preset value 500 can influence such predetermined synchronization; for example, the parameter 150 can be an electrical parameter of the waveform 350 or a mechanical parameter associated to the couple of contacts 3, 4.

Advantageously, the control means 201 are adapted to modify the initially set time duration $T_P$, of the time cycles 300 so as to keep the desired predetermined synchronization between the switching of the at least one couple of contacts 3, 4 and the waveform 350, even if the actual value of the parameter 150 is not equal to the presumed preset value 500.

Preferably, the method step 103 comprises the following steps 107 and 108:

measuring the value of the parameter 150; and comparing the measured valued to the preset value 500; and the method step 105 comprises:

calculating a correcting factor using the preset value 500 and the measured value of the parameter 150 (method step 109); and applying the correcting factor to the predetermined time duration $T_P$ (method step 110).

According to method steps 107 and 108, the detecting means 202 are adapted to receive a measure of or measure the value of the parameter 150, and to compare such measured value to the present value 500. The control means 201 are adapted to carry out the method steps 109 and 110.

A preferred but not limited way of carrying out the method 100 and a corresponding preferred but not limited embodiment of the control system 200 are hereinafter illustrated by making reference to their application in controlling the exemplary phase 2 illustrated in FIGS. 2-7.

Figure 11:
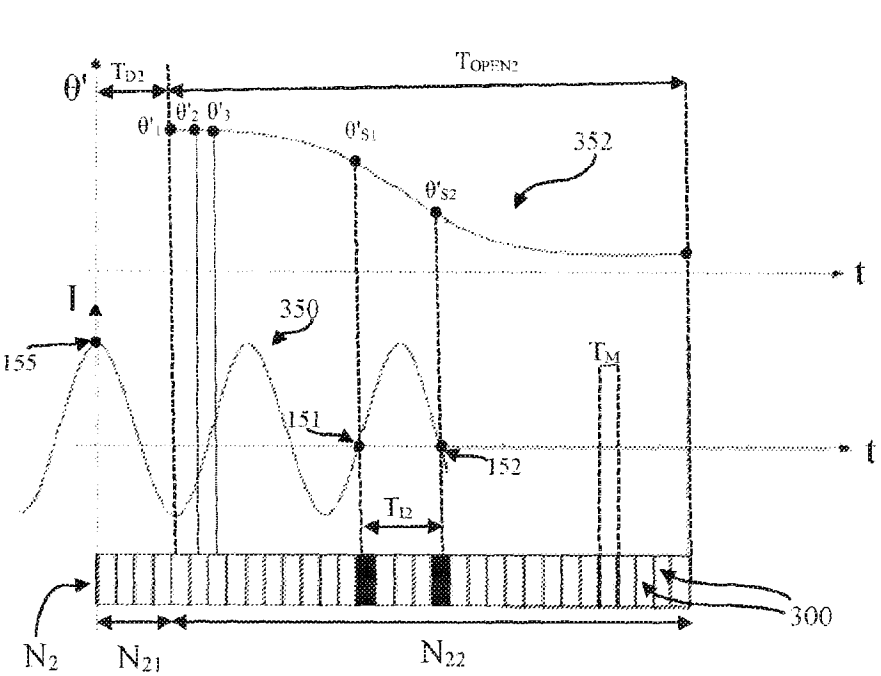
FIGS. 10-14 show waveforms and control profiles for illustrating exemplary applications of the control method according to the present invention.
Figure 10:
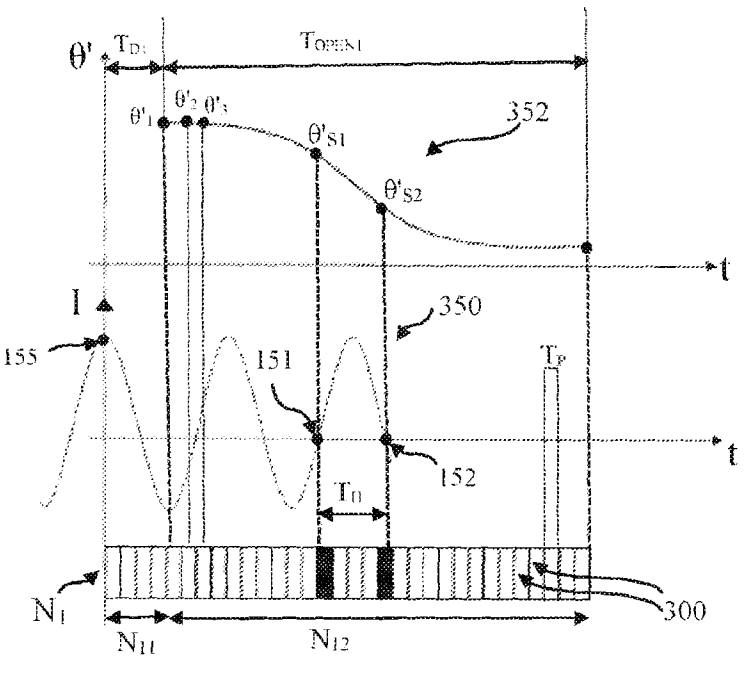

With reference to FIGS. 10 and 11, the control means 201 are adapted to execute the method step 104 or the method steps 105-106 for controlling an opening actuation of the movable contact 10 from the closed position to the full-open position, in such a way that:

the movable contact 10 separates from the fixed contact 11 at a predetermined electrical angle 151 of the waveform 350 (opening switch of the couple of contacts 4);

the movable contact 10 separates from the fixed contact 12 at a predetermined electrical angle 152 of the waveform 350, subsequent to the predetermined electrical angel 151 (opening switch of the couple of contacts 3).

For example, as illustrated in FIGS. 10 and 11, the predetermined electrical angle 151 corresponds to a positive going zero-crossing 151 of the waveform 350 of a current flowing through the phase 2. In this way, the current starts flowing through the at least one semiconductor device 30 at the separation of the movable contact 10 from the fixed contact 11, without arc generations between the contacts 10 and 11 under separation.

The predetermined angle 152 corresponds to the following negative going zero-crossing 152 of the current waveform 350. In this way, the separation of the movable contact 10 from the fixed contact 12 is advantageously controlled to occur when the at least one semiconductor device 30 starts blocking the current flowing there-through, hence avoiding arc generations between the contacts 10 and 12 under separation.

Figure 13:
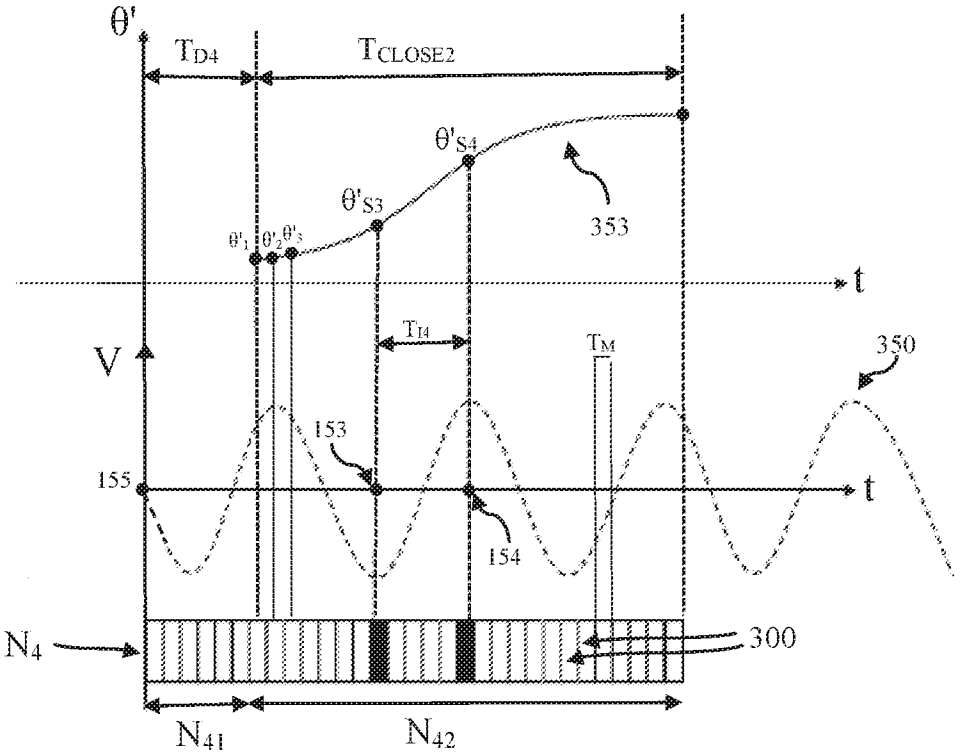
Figure 12:
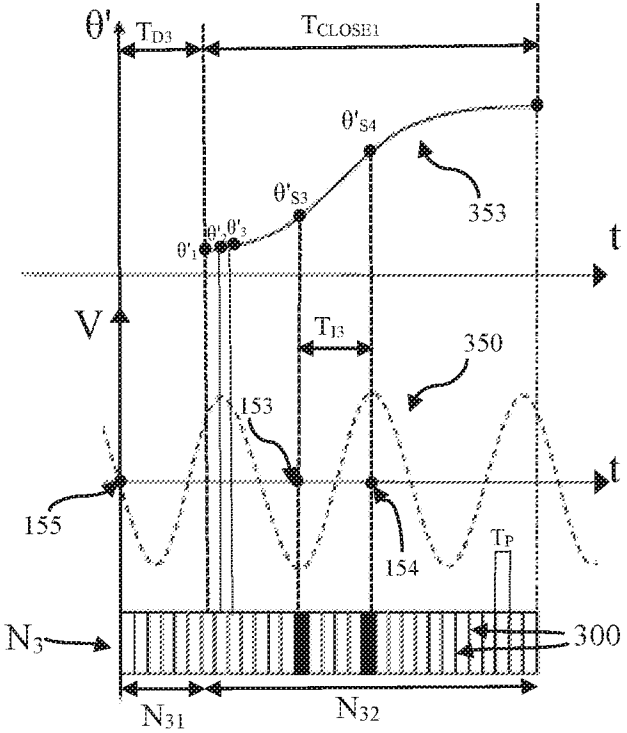

With reference to FIGS. 12 and 13, the control means 201 are also adapted to execute the method step 104 or the method steps 105-106 for controlling a closure actuation of the movable contact 10 from the full-open position to the closed position, in such a way that:

the movable contact 10 starts contacting the fixed contact 12 at a predetermined electrical angle 153 of the waveform 350 (closure switch of the couple of contacts 3);

the movable contact 10 starts contacting the fixed contact 11 at a predetermined electrical angle 154 of the waveform 350, subsequent to the predetermined electrical angle 153 (closure switch of the couple of contacts 4).

For example, as illustrated in FIGS. 12 and 13, the predetermined electrical angle 153 corresponds to a negative peak instant 153 of the waveform 350 of a voltage signal associated to the phase 2. In this way, when the voltage amplitude becomes positive the at least one semiconductor device 30 can start conducting the current flowing through the phase 2, without arcs between the contacts 10 and 12 and without inrush effects.

The predetermined electrical angle 154 corresponds to the following positive peak instant 154 of the voltage waveform 350; in this way, the current of the phase 2 can start flowing through the coupled contacts 10 and 11 before that the at least one semiconductor device 30 blocks it.

According to method step 104, if the detected value of the parameter 150 corresponds to the preset value 500, the control means 102 are adapted to execute the above control of the opening or closure actuation of the movable contact 10 while keeping the initially set time duration $T_P$ of the cycles 300.

According to method steps 105 and 106, if the detected value of the parameter 150 does not correspond to the preset value 500, the control means 201 are adapted to execute the above control of the opening or closure actuation of the movable contact 10 by using the modified time durations $T_M$ for the time cycles 300.

In this way, the desired synchronization between the switchings of the couple of contacts 3, 4 and the corresponding predetermined electrical angles 151-154 is kept even if the effective value of the parameter 150 differs from the preset value 500.

Preferably, both method steps 104 and 106 comprise a method step 111 of detecting a reference point 155 of the waveform 350; accordingly, the control system 200 comprises detecting means 203 adapted to detect the reference point 155.

According to the examples illustrated in FIGS. 10-14, preferably the method steps 104 and 106 further comprise respectively:

- setting for the control means 201 a first predetermined number $N_1$, $N_3$ of time cycles 300 with the predetermined time duration $T_P$, starting from the detection of the reference point 155 (method step 112);
- setting for the control means 201 a second predetermined number $N_2$, $N_4$ of time cycles 300 with the modified time duration $T_M$ starting from the detection of the reference point 155 (method step 113).

According to method steps 112 and 113, the control means 201 are adapted to:

- use the first predetermined number $N_1$, $N_3$ of time cycles 300, when the detected value of the parameter 150 is equal to the preset value 500; and
- use the second predetermined number $N_2$, $N_4$ of time cycles 300, when the detected value of the parameter 150 is different with respect to the preset value 500.

The first predetermined number $N_1$, $N_3$ of time cycles 300 having the predetermined time duration $T_P$ is equal to the second predetermined number $N_2$, $N_4$, of time cycles 300 having the modified time duration $T_M$.

Preferably, the first predetermined number $N_1$, $N_3$ of time cycles 300 comprises a predetermined number $N_{11}$, $N_{31}$ of first time cycles 300 which are counted to define a delay time $T_{D1}$, $T_{D3}$ between the detection of the reference point 155 and a starting of the actuation of the movable contact 10 between its full-open and closed positions.

Also the second predetermined number $N_2$, $N_4$ of time cycles 300 comprises a predetermined number $N_{21}$, $N_{41}$ of second time cycles 300 which are counted to define a modified time delay $T_{D2}$, $T_{D4}$, $T_{D5}$ between the detection of the reference point 155 and a starting of the actuation of the movable contact 10 between its full-open and closed positions.

The first predetermined number $N_1$, $N_3$ of time cycles 300 further comprises a predetermined number $N_{12}$, $N_{32}$ of third time cycles 300 which defines a time duration $T_{open1}$, $T_{close1}$ for the actuation of the movable contact 10 between its full-open and closed positions.

Also the second predetermined number $N_2$, $N_4$ of time cycles 300 comprises a predetermined number $N_{22}$, $N_{42}$ of fourth time cycles 300 which defined a modified time duration $T_{open\ 2}$, $T_{open\ 3}$, $T_{close1}$ for the actuation of the movable contact 10 between its full-open and closed positions.

Preferably, the method steps 112 and 113 executed by the control means 201 comprise respectively:

- controlling, during each third time cycle 300, the actuation of the movable contact 10 between its closed and full-open positions by using a closed-loop control; and
- controlling, during each fourth time cycle 300, the modified actuation of the movable contact 10 between its closed and full-open positions by using a closed-loop control.

For example, with reference to FIGS. 10-14, the control means 201 are adapted to cause the actuation of the movable contact 10 by controlling in a closed-loop way the angular position θ of the motor 13.

To this aim, the control system 200 is adapted to use a sequence of set-point values θ' for the angular positions θ to be assumed by the motor 13 during the actuation of the movable contact 10.

The control algorithm carried out by the control means 201 comprises at least one closed-loop; at each third time cycle 300 and at each fourth time cycle 300, the closed-loop is set to:

- receive a feed-back measurement related to the actual angular position θ of the motor 13;
- compare it with a value related to a corresponding set-point angular position θ', in order to calculate an error; and
- generate an output control signal to the motor 13 basing on the calculated error, such as to minimize the error itself.

For example, the at least one parameter 150 under consideration at method step 103 can comprise the frequency of the reference waveform 350. In this case, the corresponding preset frequency value $f_P$ can be the value of the nominal frequency of the electrical circuit into which the switching device 1 is installed, e.g. 50 Hz or 60 Hz.

FIG. 10 is related to the controlled opening actuation of the movable contact 10 and it shows a waveform 350 of the current flowing into the phase 2; such current waveform 350 has a frequency value corresponding to the preset frequency value $f_P$.

It is also assumed that the distance X between the fixed contacts 11, 12 of the phase 2 corresponds to a nominal value $X_N$ which is devised in the design of the switching device 1.

As a consequence, the control means 201 are adapted to execute method step 104 by:

- detecting the reference positive peak 155 of the current waveform 150 (method step 111); and
- using the first predetermined number of time cycles $N_1$ with the predetermined initially set time duration $T_P$ starting from the detection of the positive peak 155 (method step 112).

In particular, the control means 201 are adapted to firstly count the predetermined number $N_{11}$ of time cycles 300, so as to define the time delay $T_{D1}$ between the detection of the positive peak 155 and a starting of the controlled opening actuation of the movable contact 10.

In practice, the duration of the time delay $T_{D1}$ is initially set in the control means 102 as corresponding to the product $T_P \times N_{11}$.

Then, the control means 201 are adapted to use the subsequent predetermined number $N_{12}$ of time cycles 300 for executing the control of the opening actuation of the movable contact 10. In practice, the time duration $T_{open1}$ of the opening actuation of the movable contact 10 is initially set in the control means 102 as corresponding to the product $T_P \times N_{12}$.

At each time cycle 300 of the predetermined number $N_{12}$, the control means 201 are adapted to use a corresponding set-point value θ' associated to the opening actuation of the movable contact 10 carried out by the motor 13.

The allocation of a set-point value θ' to each corresponding time cycle 300 of the predetermined number $N_{12}$ results in the control profile 352 of the angular position θ illustrated in FIG. 10. For example, in FIG. 10 there is illustrated how three first set-point values $\theta'_1$ $\theta'_2$, $\theta'_3$ of the control profile 352 are used for the control tasks executed in corresponding three time cycles 300 of the predetermined number $N_{12}$. The set-point values of the angular position θ at which the motor 13 causes a separation of the movable contact 10 from the fixed contact 11 and from the fixed contact 12 are indicated as $\theta'_{S1}$ and $\theta'_{S2}$, respectively.

As illustrated in FIG. 10, the predetermined time duration $T_P$, the number of time cycles $N_{11}$ and the number of time cycles $N_{21}$ are preset in the control means 102 in such a way that, if the actual frequency value of the current waveform 350 corresponds to the preset frequency value $f_P$:

- the set-point value $\theta'_{S1}$ is controlled to occur at the positive going zero-crossing 151 of the current waveform 350; and
- the set-point value $\theta'_{S2}$ is controlled to occur at the following negative going zero-crossing 152.

If the actual frequency value of the current waveform 350 does not correspond to the preset frequency value $f_P$, the control means 102 keeping these initial settings would fail to reach the desired synchronization between the separations of the movable contact 10 from the fixed contacts 11, 12 and the current waveform 350.

In particular, under this frequency condition the desired synchronization would fail because:

- the zero crossing 151 occurs earlier or later with respect to the zero-crossing 151 in the current waveform 350 illustrated in FIG. 10, while the time delay $T_{D1}$ remains unchanged; and
- the time interval $T_{I2}$ between the zero-crossings 151 and 152 is stretched or compressed with respect to the same interval $T_{I1}$ in the current waveform 350 illustrated in FIG. 10, while the time duration $T_{open1}$ of the control profile 352 remains unchanged.

For example, FIG. 11 illustrates a waveform 350 of the current flowing into the phase 2, where such current waveform 350 has a frequency value lower that the preset frequency value $f_P$.

The difference between the actual frequency value and the preset frequency value $f_P$ is detected by the detecting means 202 at method step 103.

As a consequence of this detection, the control means 201 are advantageously adapted to stretch the predetermined time duration $T_P$ of the time cycles 300 as a function of the detected frequency difference (method step 105).

For example, the control means 201 are adapted to:

- measure or receive a measurement of the actual frequency value of the waveform 350 (method step 107);
- calculate a frequency correcting factor $K_f$ as a ratio between the preset frequency value $f_P$ and the measured frequency value (method step 109); and
- multiply the frequency correcting factor $K_f$ to the predetermined time duration $T_P$ (method step 110).

Further, the control means 201 are advantageously adapted to:

- detect the reference positive peak 155 of the current waveform 150 (method step 111); and
- use the second predetermined number of time cycles $N_2$ with the stretched time duration $T_M$ starting from the detection of the reference positive peak 155 (method step 113).

In particular, the control means 201 are adapted to firstly count the predetermined number of time cycles $N_{21}$, so as to define the modified time delay $T_{D2}$ between the detection of the reference point 155 and a starting of the controlled opening actuation of the movable contact 10. Preferably, the number $N_{21}$ of time cycles 300 for setting the modified time delay $T_{D2}$ is equal to the number $N_{11}$ of time cycles 300 for setting the preset delay time $T_{D1}$.

Then, the control means 201 are adapted to use the subsequent predetermined number $N_{22}$ of time cycles 300 for executing the control of the opening actuation of the movable contact 10.

Preferably, the number $N_{22}$ of time cycles 300 is equal to the number $N_{12}$ of time cycles 300.

At each time cycle 300 of the predetermined number $N_{22}$, the control means 201 are adapted to use a corresponding set-point value θ' associated to the opening actuation of the movable contact 10 carried out by the motor 13.

The allocation of a set-point value θ' to each corresponding time cycle 300 of the predetermined number $N_{22}$ results in the stretched control profile 352 of the angular position θ illustrated in FIG. 11.

In practice, the duration of the modified time delay $T_{D2}$ is equal to the product $T_M \times N_{21}$ and the modified control profile 352 has a time duration $T_{open2}$ equal to the product $T_M \times N_{22}$. The stretched time duration $T_M$ is such that:

- the set-point value $\theta'_{S1}$ is controlled to occur at the positive going zero-crossing 151 of the current waveform 350 illustrated in FIG. 11, even if this point 151 occurs later with respect to the positive going zero-crossing 151 of the waveform 350 illustrated in FIG. 10; and
- the set-point value $\theta'_{S2}$ is controlled to occur at the following negative going zero-crossing 152, even if the time interval $T_{I2}$ between the points 151 and 152 in the current waveform 350 illustrated in FIG. 11 is longer than the time interval $T_{11}$ between such points 151, 152 in the current waveform 350 illustrated in FIG. 10.

The above first control condition can occur because the stretching of the time duration $T_M$ results in a stretched delay time $T_{D2}$ suitable for synchronizing the execution of the time cycle 300 for reaching the set-point value $\theta'_{S1}$ to the actual positive going zero-crossing 151.

The above second control condition can occur because the stretching of the time duration $T_M$ results in the stretched the time interval $T_{12}$ between the control executions for reaching the set-point values $\theta'_{S1}$ and $\theta'_{S2}$. In practice, the control profile 352 is slowed to synchronize the control executions for reaching the set-point values $\theta'_{S1}$ and $\theta'_{S2}$ to the corresponding actual positive going and subsequent negative going zero-crossings 151 and 152.

FIG. 12 is related to the controlled closure actuation of the movable contact 10 and it illustrates a waveform 350 of a voltage associated to the phase 2, e.g. a voltage of the circuit into which the switching device 1 itself is installed.

The illustrated voltage waveform 350 has a frequency value corresponding to the preset frequency value $f_P$.

It is also assumed that the actual distance X between the fixed contacts 11 and 12 is equal to the nominal distance value $X_N$.

As a consequence, the control means 201 are adapted to execute method step 104 by:

detecting the reference negative going zero-crossing 155 of the voltage waveform 150 (method step 111); and using the first predetermined number $N_3$ of time cycles 300 with the predetermined initially set time duration $T_P$ starting from the detection of the reference point 155 (method step 112), in order to control the closure actuation of the movable contact 10.

In particular, the control means 201 are adapted to firstly count the predetermined number of time cycles $N_{31}$, so as to define the time delay $T_{D3}$ between the detection of the reference point 155 and a starting of the controlled closure actuation of the movable contact 10.

In practice, the duration of the time delay $T_{D3}$ is initially set in the control means 102 as corresponding to the product $T_P \times N_{31}$.

Then, the control means 201 are adapted to use the subsequent predetermined number $N_{32}$ of time cycles 300 for executing the control of the closure actuation of the movable contact 10.

In practice, the time duration $T_{close1}$ of the closure actuation of the movable contact 10 is initially set in the control means 102 as corresponding to the product $T_P \times N_{32}$.

At each time cycle 300 of the predetermined number $N_{32}$, the control means 201 are adapted to use a corresponding set-point value θ' associated to the closure actuation of the movable contact 10 carried out by the motor 13.

The allocation of a set-point value θ' to each corresponding time cycle 300 of the predetermined number $N_{32}$ results in the control profile 353 of the angular position θ illustrated in FIG. 12.

The set-point values of the angular position θ at which the motor 13 causes a contacting between the movable contact 10 and the fixed contact 12 and a contacting between the movable contact 10 and the fixed contact 11 are indicated as $\theta'_{S3}$ and $\theta'_{S4}$, respectively.

As illustrated in FIG. 12, the predetermined time duration $T_P$, the number of time cycles $N_{31}$ and the number of time cycles $N_{32}$ are preset in the control means 102 in such a way that, if the actual frequency value of the voltage waveform 350 corresponds to the preset frequency value:

the set-point value $\theta'_{S3}$ is controlled to occur at the negative peak instant 153 of the voltage waveform 150; and the set-point value θ'S4 is controlled to occur at the following positive peak instant 154 of the voltage waveform 350.

When the actual frequency value of the current waveform 350 does not correspond to the preset frequency value $f_P$, the control means 202 keeping these initial settings would fail to reach the desired synchronization between the couplings of the movable contact 10 with the fixed contacts 11, 12 and the voltage waveform 350.

In particular, under this frequency condition the desired synchronization would fail because:

the negative peak instant 153 occurs earlier or later with respect to the negative peak instant 153 in the voltage waveform 350 illustrated in FIG. 12, while the time delay $T_{D3}$ remains unchanged; and the time interval $T_{I4}$ between the negative and subsequent positive peak instants 153 and 154 is stretched or compressed with respect to the same interval $T_{I3}$ of the voltage waveform 350 illustrated in FIG. 12, while the time duration $T_{close1}$ of the control profile 352 remains unchanged.

For example, FIG. 13 illustrates a voltage waveform 350 having a frequency value lower that the preset frequency value $f_P$.

This frequency condition is detected by the detecting means 202 at method step 103.

As a consequence of this detection, the control means 201 are advantageously adapted to:

stretch the predetermined time duration $T_P$ of the time cycles 300 according to the difference between the actual frequency value of the voltage waveform 350 and the preset frequency value $f_P$ (method step 105);

detect the reference negative going zero-crossing 155 of the voltage waveform 150 (method step 111); and use the second predetermined number of time cycles $N_4$ with the stretched time duration $T_M$ starting from the detection of the reference point 155 (method step 113).

In particular, the control means 201 are adapted to firstly count the predetermined number $N_{41}$ of time cycles 300, so as to define the modified time delay $T_{D4}$ between the detection of the reference point 155 and a starting of the controlled closure actuation of the movable contact 10.

Then, the control means 201 are adapted to use the subsequent predetermined number $N_{42}$ of time cycles 300 for executing the control of the closure actuation of the movable contact 10.

At each time cycle 300 of the predetermined number $N_{42}$, the control means 201 are adapted to use a corresponding set-point value θ' associated to the closure actuation of the movable contact 10 carried out by the motor 13.

The allocation of a set-point value θ' to each corresponding time cycle 300 of the predetermined number $N_{42}$ results in the stretched control profile 353 of the angular position θ illustrated in FIG. 13.

In practice, the duration of the modified time delay $T_{D4}$ is equal to the product $T_M \times N_{41}$ and the modified control profile 353 has a time duration $T_{close2}$ equal to the product $T_M \times N_{42}$. The stretched time duration $T_M$ is such that:

the set-point value $\theta'_{S3}$ is controlled to occur at the negative peak instant 153 of the voltage waveform 350 illustrated in FIG. 13, even if this instant 153 occurs later with respect to the negative peak instant 153 of the waveform 350 illustrated in FIG. 12; and the set-point value $\theta'_{S4}$ is controlled to occur at the following positive peak instant 154 of the voltage waveform 350, even if the time interval $T_{I4}$ between the instants 153 and 154 in the voltage waveform 350 illustrated in FIG. 13 is longer than the time interval $T_{I3}$ between the instants 153, 154 in the voltage waveform 350 illustrated in FIG. 12.

The above first control condition can occur because the stretching of the time duration $T_M$ results in the stretched delay time $T_{D4}$ suitable for synchronizing the execution of the time cycle 300 for reaching the set-point value $\theta'_{S3}$ to the actual negative peak instant 153.

The above second control condition can occur because the stretching of the time duration $T_M$ also results in a stretched time interval $T_{I4}$ between the control executions for reaching the set-point values $\theta'_{S3}$ and $\theta'_{S4}$. In practice, the control profile 353 is slowed to synchronize the control executions for reaching the set-point values $\theta'_{S3}$ and $\theta'_{S4}$ to the corresponding negative peak instant 153 and subsequent positive peak instant 154 of the voltage waveform 350.

An example of how the control system 200 is adapted to execute the method 100 in case of a difference between the value of the actual distance X between the fixed contacts 11 and 12 and the nominal distance value $X_N$ is disclosed below.

In particular, reference is made for simplicity only to a controlled opening actuation of the movable contact 10, where it is assumed that the actual distance X is smaller than its nominal value and that the actual frequency value of the reference waveform 350 is equal to the preset frequency value $f_P$.

As disclosed above, the control profile 352 illustrated in FIG. 10 is executed by the control means 201 by using the predetermined number $N_{12}$ of time cycles 300 with the predetermined time duration $T_P$.

The control profile 352 is used while presuming a correspondence between the actual distance X and the preset distance value $X_P$.

Hence, according to these settings, the control means 201 would control the occurrence of the set-point value $\theta'_{S2}$ at the corresponding negative going zero-crossing 152, presuming that such controlled angular position $\theta'_{S2}$ of the motor 13 is the right angular position θ for causing the separation of the movable contact 10 from the fixed contact 12.

However, the separation of the movable contact 10 from the fixed contact 12 would already be occurred at the negative going zero-crossing 152, because the actual distance X is smaller than the nominal distance value $X_N$.

The detecting means 202 are adapted to detect the difference between the actual distance X and the its nominal $X_N$.

For example, the detecting means 202 are adapted to:

- measure or receive a measurement of a time $T_{lapse}$ lapsed between the separation of the movable contact 10 from the fixed contact 11 and the subsequent separation of the movable contact 10 from the fixed contact 12 (method step 107); and
- compare the measured elapsed time $T_{lapse}$ to a preset time interval $T_{IP}$ (method step 108).

The lapsed time $T_{lapse}$ is preferably measured during routing tests of the switching device 1.

Figure 14:
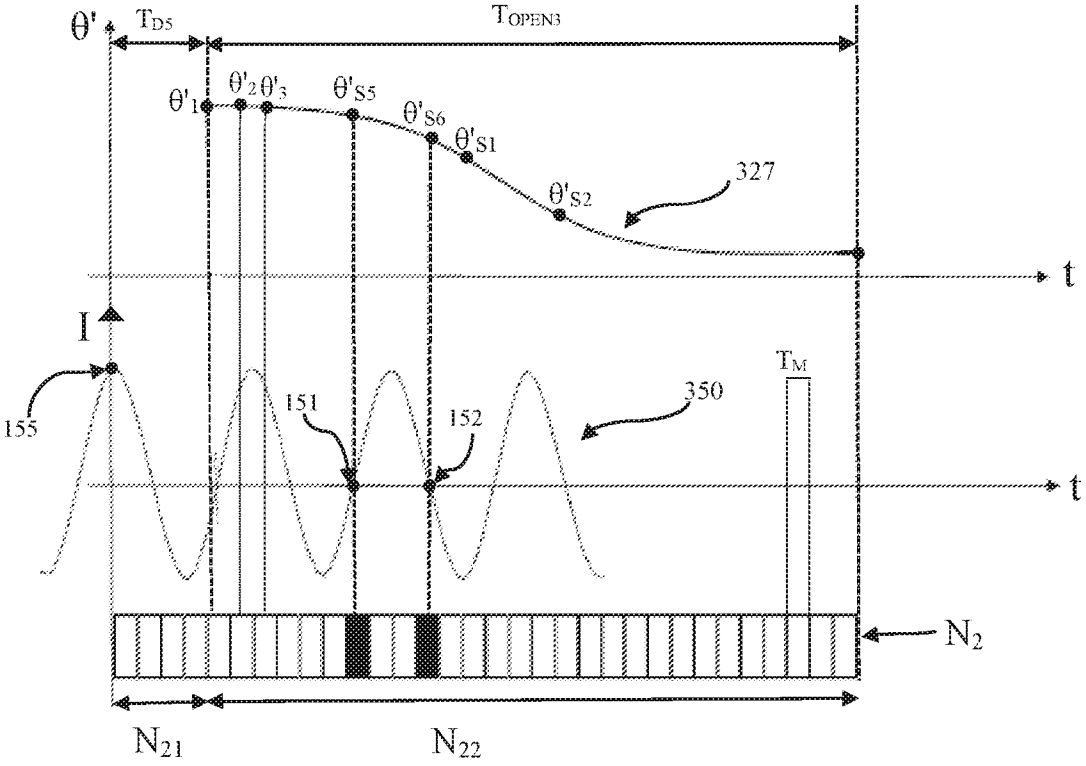

FIG. 14 shows the same current waveform 350 as illustrated in FIG. 10, i.e. with an actual frequency value corresponding to the preset frequency value $f_P$.

When the measured elapsed time $T_{lapse}$ is not equal to the preset time interval $T_{IP}$, the control means 201 are advantageously adapted to stretch the predetermined time duration $T_D$ of the time cycles 300 basing on the detected difference between the elapsed time $T_{lapse}$ and the preset time interval $T_{IP}$ (method step 105).

For example, the control means 201 are adapted to:

- calculate a mechanical correcting factor $K_M$ as a ratio between the preset time interval $T_{IP}$ and the measured elapsed time $T_{lapse}$ (method step 109); and
- multiply the mechanical correcting factor $K_M$ to the predetermined time duration $T_P$ (method step 110).

Whit reference to FIG. 14, the control means 201 are further adapted to:

- detect the reference positive peak 155 of the current waveform 150 (method step 111); and
- use the second predetermined number $N_2$ of time cycles 300 with the stretched time duration $T_M$ starting from the detection of the reference point 155 (method step 113).

In particular, the control means 201 are adapted to firstly count the predetermined number $N_{21}$ of time cycles 300, so as to define the modified time delay $T_{D5}$ between the detection of the reference point 155 and a starting of the controlled opening actuation of the movable contact 10. Then, the control means 201 are adapted to use the subsequent predetermined number $N_{22}$ of time cycles 300 for executing the control of the opening actuation of the movable contact 10. In particular, the control means 201 are adapted to use a corresponding set-point value θ' associated to the opening actuation of the movable contact 10 at each time cycle 300 of the predetermined number $N_{22}$.

This allocation of a set-point value θ' to each corresponding time cycle 300 of the predetermined number $N_{22}$ results in the stretched control profile 327 illustrated in FIG. 14.

In practice, the duration of the modified time delay $T_{D5}$ is equal to the product $T_M \times N_{21}$ and the stretched control profile 327 has a time duration $T_{open3}$ equal to the product $T_M \times N_{22}$.

Without stretching the predetermined time duration $T_P$ of the cycles 300, the real separation of the movable contact 10 from the fixed contact 12 would be controlled to occur earlier than the zero going reference point 152, at an angular set-point position $\theta'_{S6}$. This is because the actual distance X between the fixed contacts 11 and 12 is smaller than the nominal distance $X_N$.

The stretched time duration $T_M$ is such that:

- a set-point value $\theta'_{S5}$ is controlled to occur at the positive going zero-crossing 151 of the current waveform 350 instead of the set-point value $\theta'_{S1}$; and
- the set-point value $\theta'_{S6}$ is controlled to occur at the following negative going zero-crossing 152 instead of the set-point value $\theta'_{S2}$.

In practice, the control profile 327 is stretched such that the set-point value $\theta'_{S6}$ is correctly controlled at the negative going zero-crossing 152 instead of the set-point value $\theta'_{S2}$.

The above disclosed exemplary applications of the control method 100 and related control system 200 comprise the case of an actual frequency value of the waveform 350 not corresponding to the preset frequency value $f_P$ or the case of an actual distance X between the fixed contacts 11, 12 not corresponding to the nominal distance $X_N$.

In case that the means 202 detect both the above mentioned difference conditions, the control means 201 are adapted to execute the method steps 105 and 106 by modifying the preset time duration $T_P$ of the time cycles 300 according to both the detected differences.

For example, if following routing tests on the switching device 1 it is detected that the value of the actual distance X between the fixed contacts 11, 12 does not correspond to the nominal distance value $X_N$, the initially set predetermined time duration $T_P$ of the time cycles 300 is modified by using the mechanical correcting factor $K_M$.

When the difference between the value of the actual frequency of the reference waveform 350 and the preset frequency value $f_P$ is further detected, the initially set predetermined time duration $T_P$ is also modified by using the frequency correcting factor $K_f$.

In practice, the modified time duration $T_M$ of the time cycles 300 is equal to: $T_P \times K_M \times K_f$.

It has been seen how the control method 100 and control system 200 allow achieving the intended object offering some improvements over known solutions.

In particular, the method 100 and control system 200 allow to keep a desired synchronization between the switchings of the couple of contacts 3, 4 and a reference waveform 350, even if at least one parameter 150 associated to the phase 2 and which can influence the synchronization does not correspond to a preset value 500.

Indeed, the method 100 and control system 200 are adapted to modify the predetermined time duration $T_P$ of the control cycles 300 according to the detected difference between the actual value of the parameter 150 and the preset value 500. In this way, the control speed is suitably slowed or accelerated for keeping the desired synchronization.

For example, it has been seen how the execution of the control method 100 by the control system 200 keeps the desired synchronization even if the actual frequency value of the reference waveform 350 is not equal to the present frequency value $f_P$.

In practice, the control speed is dynamically changed according to the variation of the actual frequency value of the reference waveform 350 with respect to the preset frequency value $f_P$, for example by modifying the predetermined time duration $T_P$ of the cycles 300 with the correcting frequency factor $K_f$.

For example, it has been seen how the execution of the control method 100 by the control system 200 keeps the desired synchronization even if the actual distance X between the fixed contacts 11 and 12 is not equal to the nominal distance value $X_N$.

In practice, following routine tests of the switching device 1, the control speed is set according to the detected difference between the actual distance X and its nominal value $X_N$, for example by modifying the predetermined time duration $T_P$ of the cycles 300 with the correcting factor $K_M$.

The control method 100 and control system 200 thus conceived are also susceptible of modifications and variations, all of which are within the scope of the inventive concept as defined in particular by the appended claims.

In particular, the control method 100 can be applied to switching devices of a different type than the switching device 1 illustrated in FIGS. 1-7.

For example, the method 100 can be applied to a circuit breaker having for each phase one couple of contacts. In this case, the execution of the method 100 would be useful at least for keeping a desired synchronization between an opening switching of this couple of contacts and a predetermined electrical angle of a reference signal waveform associated to the phase, even if the actual frequency value of the reference waveform is not equal to the nominal preset value.

The control means 201 may comprise: microcontrollers, microcomputers, minicomputers, digital signal processors (DSPs), optical computers, complex instruction set computers, application specific integrated circuits, a reduced instruction set computers, analog computers, digital computers, solid-state computers, single-board computers, or a combination of any of these.

The detecting means 202 can be any electronic device or unit adapted to measure or receive a measurement of the actual value of the parameter 150, and to compare it with the preset value 500; the detecting means 202 can be separated but operatively connected to the control means 201, or they can be implemented into the control means 201 themselves.

The detecting means 203 can be any electronic device or unit adapted to detect the occurrence of the reference pint 155 of the waveform 350, the detecting means 203 can separated but operatively connected to the control means 201, or they can be implemented into control means 201.

In practice, all parts/components can be replaced with other technically equivalent elements; in practice, the type of materials, and the dimensions, can be any according to needs and to the state of the art.

The invention claimed is:

1. A method for controlling a switching device having at least one phase comprising at least one couple of contacts which can be actuated for switching between a closed condition, where the contacts are coupled to each other, and an open condition, where the contacts are separated from each other, said method comprising:

a) providing control means for controlling an actuation of said at least one couple of contacts, said control means being adapted to operate using time cycles;

b) setting said time cycles with a predetermined time duration;

c) detecting a difference of a value of a parameter associated to the phase with respect to a preset value;

d) if said value of the parameter is equal to the preset value, controlling the actuation of said at least one couple of contacts through said control means using the time cycles with said predetermined time duration, so as the switching between the open and closed conditions is controlled to occur at a predetermined electrical angle of a waveform of an electrical signal associated to the phase;

wherein:

e) when said difference is detected, modifying the predetermined time duration according to the detected difference; and f) controlling the actuation of said at least one couple of contacts through said control means using the time cycles with the modified time duration, wherein said modification of the predetermined time duration is such that the switching between the open and closed conditions is controlled to occur at said predetermined electrical angle of the waveform.

2. The method according to claim 1, wherein said step c) comprises:

measuring the value of said parameter; and comparing the measured value to the preset value;

and wherein said step e) comprises:

calculating a correcting factor using the preset value and the measured value of the parameter; and applying said correcting factor to said predetermined time duration.

3. The method according to claim 1, wherein:

said steps d) and f) comprise detecting a reference point of the waveform;

said step d) comprises setting for the control means a first predetermined number of time cycles with said predetermined time duration, starting from the detection of said at least one reference point;

said step f) comprises setting for the control means a second predetermined number of time cycles with said modified time duration, starting from the detection of said at least one reference point;

said second predetermined number being equal to said first predetermined number.

4. The method according to claim 3, wherein:

said first predetermined number of time cycles comprises a predefined number of time cycles which define a time delay between the detection of the at least one reference point and a starting of the actuation of the at least one couple of contacts;

said second predetermined number of time cycles comprises a predefined number of time cycles which define a time delay between the detection of the at least one reference point and a starting of the actuation of the at least one couple of contact.

5. The method according to claim 3, wherein:

said first predetermined number of time cycles comprises a predetermined number of time cycles which define a first time duration for the actuation of said at least one couple of contacts; and said second predetermined number of time cycles comprises a predetermined number of time cycles which define a second time duration for the actuation of the at least one couple of contacts;

said step d) comprises controlling, during each one of the time cycles defining said first time duration, the actuation of said at least one couple of contacts by using a closed-loop control; and said step f) comprises controlling, during each one of the time cycles defining said second duration, the actuation of said at least one couple of contacts by using a closed-loop control.

6. The method according to claim 1, wherein said parameter is the frequency of the waveform of said electrical signal.

7. A control system for controlling a switching device having at least one phase comprising at least one couple of contacts which can be actuated for switching between a closed condition, where the contacts are coupled to each other, and an open condition, where the contacts are separated from each other, said control system comprising:

control means for controlling an actuation of said at least one couple of contacts, said control means being adapted to operate by using time cycles, and said time cycles being set with a predetermined time duration;

means for detecting a difference of a value of a parameter associated to the phase with respect to a preset value;

wherein, if said value of the parameter is equal to said preset value, the control means are adapted to control the actuation of said at least one couple of contacts using the time cycles with said predetermined time duration, so as the switching between the closed and open conditions is controlled to occur at a predetermined electrical angle of a waveform of an electrical signal associated to the phase;

wherein said control means are adapted to:

when the difference between the value of the parameter and the preset value is detected, modify the predetermined time duration according to the detected difference; and control the actuation of said at least one couple of contacts using the time cycles with the modified time duration, wherein the modification of the predetermined time duration is such that the switching between the closed and open conditions is controlled by the control means to occur at said predetermined electrical angle of the waveform.

8. The control system according to claim 7, wherein said detecting means are adapted to:

measure or receive a measurement of the value of said parameter; and compare the measured value of said parameter with respect to the preset value;

and wherein said control means are adapted to:

calculate a correcting factor using said preset value and the measured value of said parameter; and apply said correcting factor to said predetermined time duration.

9. The control system according to claim 7, comprising means for detecting a reference point of the waveform of said electrical signal, and wherein said control means are adapted to:

use a first predetermined number of time cycles with said predetermined time duration starting from the detection of said at least one reference point, if the value of said parameter is equal to said preset value; and use a second predetermined number of time cycles with said modified time duration starting from the detection of said at least one reference point, if the difference between the value of said parameter and said preset value is detected;

said second predetermined number being equal to said first predetermined number.

10. The control system according to claim 9, wherein:

said first predetermined number of time cycles comprises a predetermined number of time cycles which defines a time delay between the detection of the at least one reference point and a starting of the actuation of said at least one couple of contacts;

said second predetermined number of time cycles comprises a predetermined number of time cycles which defines a time delay between the detection of the at least one reference point and a starting of the actuation of said at least one couple of contacts.

11. The control system according to claim 9, wherein:

said first predetermined number of time cycles comprises a predetermined number of time cycles which defines a first time duration of the actuation of said at least one couple of contacts; and said second predetermined number of time cycles comprises a predetermined number of time cycles which defines a second time duration of the actuation of said at least one couple of contacts;

and wherein said control means are adapted to:

control, during each one of the time cycles defining said first time duration, the actuation of said at least one couple of contacts by using a closed-loop control;

control, during each one of the time cycles defining said second time duration, the actuation of said at least one couple of contacts by using a closed-loop control.

12. The control system according to claim 7, wherein:

said switching device is adapted to connect/disconnect to/from each other two parts of an electrical circuit;

said phase comprises at least one semiconductor device adapted to block a current flowing there-through in a first direction and to allow a current flowing there-through in a second direction opposed to the first direction;

wherein said at least one couple of contacts comprises:

a first couple of contacts which is adapted to cause, through its switching from the open condition to the closed condition, a connection in series of said at least one semiconductor device between the two parts of said electrical circuits;

a second couple of contacts which is adapted to short-circuit, through its switching from the open condition to the closed condition, said at least one semiconductor device; and wherein said control means are adapted to control the actuation the first and second couples of contacts in such a way that:

the switching of the second couple of contacts from the closed condition to the open condition and the switching of the first couple of contacts from the closed condition to the open condition occur at a first predetermined electrical angle and a second subsequent predetermined electrical angle, respectively, of the waveform;

the switching of the first couple of contacts from the open condition to the closed condition and the switching of the second couple of contacts from the open condition to the closed condition occur at third predetermined electrical angle and at a fourth subsequent predetermined electrical angle, respectively, of the waveform.

13. The control system according to claim 12, wherein said parameter comprises the distance between one contact of said first couple of contacts and one contact of said second couple of contacts.

14. The control system according to claim 7, wherein said parameter comprises the frequency of said waveform of the electrical signal.

15. A switching device comprising a control system according to claim 7.

16. A switchgear comprising a control system according to claim 7 or a switching device according to claim 15.

* * * * *